US007328979B2

(12) United States Patent
Decre et al.

(10) Patent No.: US 7,328,979 B2
(45) Date of Patent: Feb. 12, 2008

(54) SYSTEM FOR MANIPULATION OF A BODY OF FLUID

(75) Inventors: Michel Marcel Jose Decre, Eindhoven (NL); Thomas Pierre Cornil Duriez, Paris (FR); Stein Kuiper, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 39 days.

(21) Appl. No.: 10/579,154

(22) PCT Filed: Nov. 9, 2004

(86) PCT No.: PCT/IB2004/052355

§ 371 (c)(1),
(2), (4) Date: May 12, 2006

(87) PCT Pub. No.: WO2005/047696

PCT Pub. Date: May 26, 2005

(65) Prior Publication Data

US 2007/0139486 A1 Jun. 21, 2007

(30) Foreign Application Priority Data

Nov. 17, 2003 (EP) ..... 03104229

(51) Int. Cl.
*B41J 2/06* (2006.01)

(52) U.S. Cl. ..... 347/55; 347/54

(58) Field of Classification Search ..... 347/20, 347/54, 55, 45–47

See application file for complete search history.

(56) References Cited

U.S. PATENT DOCUMENTS 4,794,463 A * 12/1988 Tamura et al. ..... 347/55
2002/0079219 A1 6/2002 Zhao et al. ..... 204/451

OTHER PUBLICATIONS

"Verheijen et al., Reversible Electrowetting and Trapping of Charge: Model and Experiments", Langmuir 19(1999) 6616-6620.
International Search Report for International Application No. PCT/IB2004/052355, dated Feb. 11, 2005, 4 pages.

* cited by examiner

*Primary Examiner*—Juanita D. Stephens

(57) ABSTRACT

A system for manipulation of a body of fluid, in particular a fluid droplet comprises several control electrodes to which an adjustable voltage is applied to control displacement of the droplet on the basis of the electrowetting effect. There is a counter electrode having a fixed voltage between the body of fluid and one of the control electrodes. Further, as the counter electrode and the control electrodes are located at the same side of the fluid droplet, the fluid droplet is freely accessible at its side remote from the counter electrode and the control electrodes. Hence, the fluid droplet can be employed as an object carrier and a pay-load can be placed on the droplet from the freely accessible side.

9 Claims, 2 Drawing Sheets

SYSTEM FOR MANIPULATION OF A BODY OF FLUID

Figure 1:
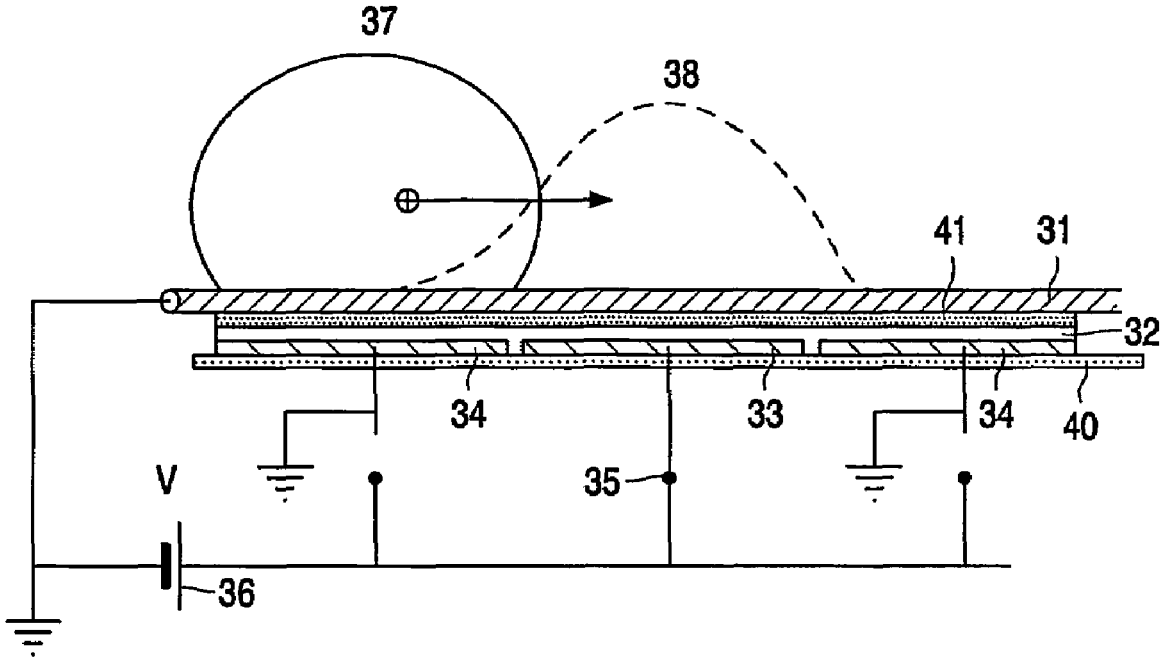

The invention pertains to a system for manipulation of a body of fluid, in particular a fluid droplet.

Such a system for manipulation of a fluid droplet is known from the US-patent application US 2002/0079219.

The known system for manipulation of a fluid droplet concerns a micro-fluidic chip having reservoirs in fluid connection by one or more microchannels. Integrated electrodes are provided that function as control electrodes. Each of these integrated electrodes is positioned in one of the reservoirs such that the electrodes electrically contacts a material or medium contained in the reservoir. A voltage controller is provided to which the integrated electrodes are connected. By applying electrical voltages to the integrated electrodes, samples of the material or medium are electrokinetically driven though the microchannels to carry out biochemical processes.

An object of the invention is to provide a system for manipulation of a fluid droplet in which the control over and reliability of the manipulation of the fluid droplet is improved.

This object is achieved by a system for manipulation of a fluid droplet according to the invention comprising several control electrodes to which an adjustable voltage is applied, a counter electrode having a fixed voltage and being provided between the fluid droplet and one of the control electrodes, covering a part of the surface of the respective control electrodes, in particular the ratio of the width of the counter electrode to the width of the control electrodes being in the range from $10^{-5}$ to 0.9.

The fluid body, for example in the form of a fluid droplet comprises a polar and/or electrically conducting first fluid material. At one side the fluid body is adjacent to a solid wall. The rest of the droplet is surrounded by at least one second fluid, which may be a liquid, a gas or a vapour with a lower polarity and/or lower electrical conductivity than the first fluid of the fluid body. The droplet and the fluid or fluids that surround the droplet should be immiscible, i.e. they should tend to separate into separate bodies of fluid. The counter electrodes and the counter electrodes are provided at the side of the fluid droplet facing the solid wall. Usually, these electrodes are part of the solid wall. Because the fluid droplet is in electrical contact with the counter electrode at a fixed voltage, the fluid droplet is maintained accurately at the same fixed voltage. For example, the counter electrode is kept at fixed ground potential, so that the fluid droplet is maintained at ground potential. When a control electrode adjacent to the actual position of the fluid droplet is activated, the fluid droplet is moved from one control electrode to the next under the influence of the electrowetting effect. Because the fluid droplet is maintained at the fixed voltage of the counter electrode, the electrowetting activation causing movement of the fluid droplet is made more efficient. Notably, the potential differences that drive the displacement of the fluid droplet are more accurately controlled. It is avoided that inadvertently the fluid droplet attains the potential of any one of the control electrodes that makes unintentional relatively close electrical contact with other structures of the system for manipulation of a fluid droplet. Also it is avoided that the fluid droplet has a floating potential.

Further, as the counter electrode and the control electrodes are located at the same side of the fluid droplet, the fluid droplet is freely accessible at its side remote from the counter electrode and the control electrodes. Hence, the fluid droplet can be employed as an object carrier and a pay-load can be placed on the droplet from the freely accessible side. The pay-load can be unloaded from the fluid droplet at the freely accessible side of the fluid droplet.

An electrical insulation is provided between the counter electrode and the respective control electrodes. Hence, the potential difference between the counter electrode and any activated control electrode(s) can be accurately maintained. Furthermore, the fluid droplet is more strongly electrically insulated from the control electrodes than from the counter electrodes, so that the electrical potential of the fluid droplet is very close to the electrical potential of the counter electrode and a substantial potential difference between the fluid droplet and any of the control electrodes can be maintained. When the thickness of the electrical insulation over the control electrodes is much larger than the thickness of the electrical insulation over the counter electrode, the fluid body will attain approximately the electrical potential of the counter electrode. Hence, the potential difference between the fluid droplet and the activated control electrodes is accurately maintained so as to accurately control displacement of the fluid droplet as driven by these potential differences.

Preferably, the electrical insulation has a hydrophobic surface towards the fluid droplet, for example a fluid contact coating is disposed over the electrical insulation. The fluid contact coating has low-hysteresis for advancing and receding motion of the fluid body. Good results are achieved when a hydrophobic coating is employed as the fluid contact coating. For example, the hydrophobic coating is disposed as hydrophobic monolayer, such as a fluorosilane monolayer. The electrical insulation of such a hydrophobic monolayer allows the electrical potential of the fluid droplet to closely approximate the electrical potential of the counter electrode. Hence, the fluid droplet is in contact with the hydrophobic surface of the electrical insulation which supports unrestricted movement of the fluid droplet from one control electrode to the next. The term hydrophobic indicates here that the interfacial energies $\gamma_{\alpha\beta}$ related to the solid wall, the first fluid of the fluid droplet and the surrounding second fluid, denoted respectively by the subscripts S, F1, and F2, meet the condition:

$$\frac{\gamma_{SF_2} - \gamma_{SF_1}}{\gamma_{F_1F_2}} \leq 1$$

Notably, the fluid droplet makes an interior equilibrium contact angle with the hydrophobic surface that is more than 45°; very good results are achieved when the contact angle is in the range from 70° to 110°.

Preferably, the counter electrode has a hydrophobic surface, for example a hydrophobic coating is disposed on the counter electrode on its side facing away from the control electrode. Accordingly, the adhesion between the counter electrode and the fluid droplet is reduced, or in other words the contact angle between the fluid droplet and the counter electrode is relatively large, for example in the range from 70° to 110°. When the counter electrode has a hydrophobic surface it is avoided that the fluid droplet sticks to the counter electrode and displacement of the fluid droplet is made easier. When the counter electrode with the hydrophobic surface is employed it has appeared that it is not necessary that the electrical insulation has a hydrophobic surface.

In all cases it is important that the difference between the advancing contact angle of the liquid droplet and its receding contact angle allows a sufficient electrowetting effect to switch between holding the fluid body in place and displacing it. This difference, called contact angle hysteresis, can prevent the droplet from moving under the electrowetting effect, in the way that it causes the fluid droplet to stick to the surface more after it has made the first contact. In practice, well controlled displacement of the fluid body is achieved when the difference or hysteresis between the advancing and receding contact angle does not exceed 20°.

The measures of hydrophobic surfaces or hydrophobic coatings on the counter electrode and/or the electrical insulation, respectively are particularly advantageous when the control electrodes are arranged in a two-dimensional pattern so that essentially unrestricted displacement in two-dimensions of the fluid droplet is made possible.

These and other aspects of the invention will be further elaborated with reference to the embodiments defined in the dependent Claims.

Figure 2:
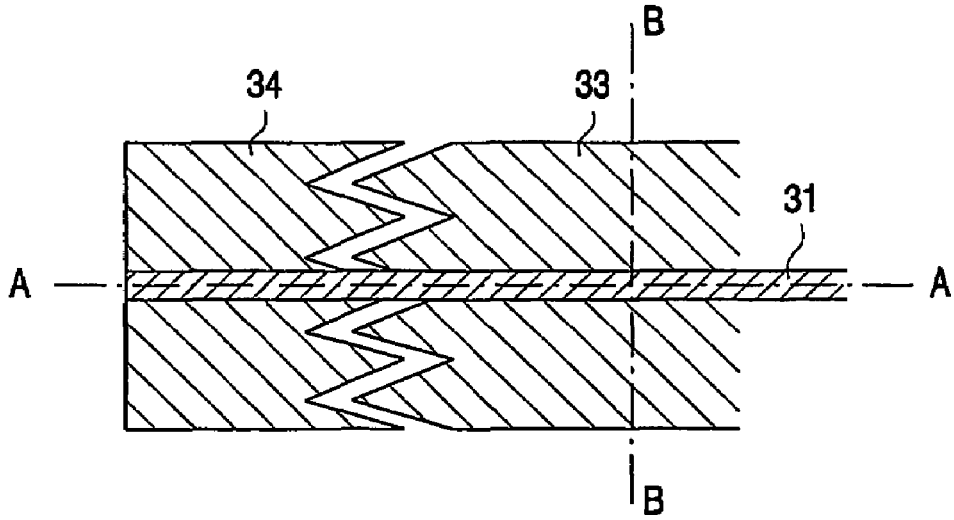
Figure 3:
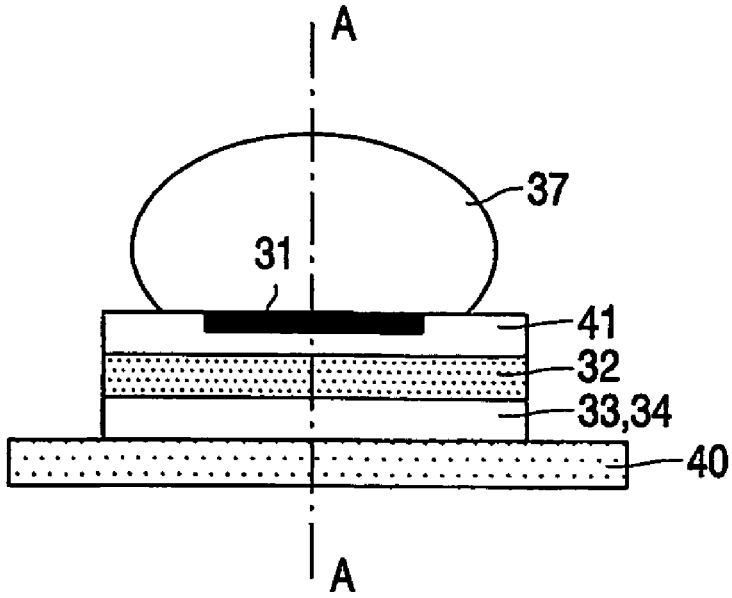
Figure 4:
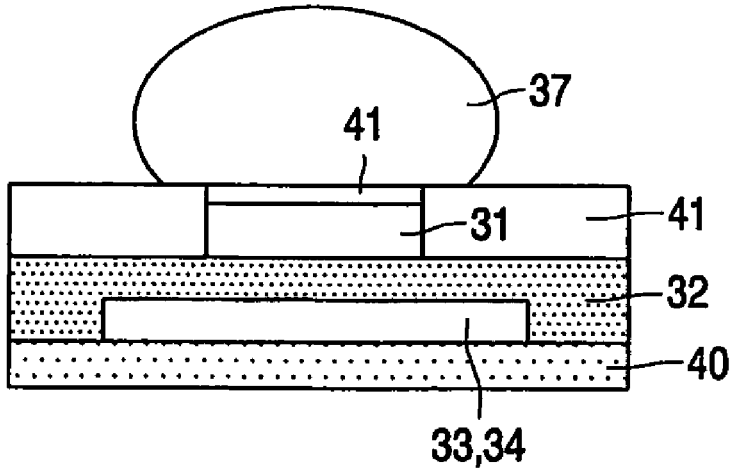

These and other aspects of the invention will be elucidated with reference to the embodiments described hereinafter and with reference to the accompanying drawing wherein FIG. 1 shows a schematic cross section of an embodiment of the system for manipulation of a fluid droplet, FIG. 2 shows a schematic top view of the embodiment of the system for manipulation of a fluid droplet of FIG. 1, FIG. 3 shows a schematic cross section of an embodiment of the system for manipulation of a fluid droplet and FIG. 4 shows a schematic cross section of an alternative embodiment of the system for manipulation of a fluid droplet.

FIG. 1 shows a schematic cross section of an embodiment of the system for manipulation of a fluid droplet. In particular FIG. 1 shows a cross section along the plane A-A, indicated in FIGS. 2 and 3, transverse to the surface of the substrate 40. On a substrate 40 the control electrodes 33,34 are disposed. Also the counter electrode 31 is shown. Between the counter electrode 31 and the control electrodes 33,34 there is a an electrical insulator 32 which is formed as an electrical insulation layer, for example parylene-N. On top of the electrical insulation layer and preferably also on top of the counter electrode the hydrophobic coating 41 is disposed, for example the amorphous fluorpolymer AF-1600, provided by Dupont. As an alternative the electrical insulation layer is formed of a hydrophobic insulator such as AF-1600. The counter electrode may be coated with a monolayer of hydrophobic material, for example a fluorosilane.

An electrical control system is electrically connected to the control electrodes. The electrical control system includes a voltage source 36 and a set of switches 35. The switches are operated in a controlled fashion so as to successive activate adjacent control electrodes. Any switching mechanism can be employed; very suitable switches are for example thin-film transistors or optocouplers. In FIG. 1, the situation is shown where the control electrode 33 is being activated. The fluid droplet 37 that is currently positioned at control electrode 34 will then be displaced, as shown in dashed lines, to the adjacent control electrode 33 under the influence of the electrowetting effect. In practice the contact angles of the displacing droplet 38 at its advancing side (to the right in the Figure) is smaller than the contract angle at its receding side (to the left in the Figure). This electrical voltage influences the interaction between the carrying fluid droplet and the surface of the substrate. Notably, the cosine of the contact angle of the fluid droplet and stack of layers on the substrate 40 decreases approximately with the square of the modulus of the electrical potential of the stack relative to the fluid. That is, the stack is effectively made more hydrophilic in the region of the electrodes when an electrical voltage is applied. This phenomenon is often termed 'electrowetting' and is discussed in more detail in the paper '*Reversible electrowetting and trapping of charge: Model and Experiments*', by H. J. J. Verheijen and M. W. J. Prins in Langmuir 19(1999)6616-6620.

FIG. 2 shows a schematic top view of the embodiment of the system for manipulation of a fluid droplet of FIG. 1. Notably FIG. 2 shows that the counter electrode 31 is narrower than the control electrodes 33,34. In particular the ratio of the width of the counter electrode to the width of the control electrodes can be in the range from $10^{-5}$ to 0.9; good results are especially obtained in the narrower range from $10^{-3}$ to 0.2. It is also important that the counter electrode not be wider than typically half the so-called capillary $l_c$ length $$l_c = \sqrt{\frac{\gamma_{LV}}{\rho g}},$$

where $\gamma_{LV}$ is the surface tension of the liquid, ρ the density of the fluid, and g the acceleration of gravity. In the situation where the fluid body is surrounded by a surrounding fluid, then the capillary length is independent of gravity. This guarantees that perturbations of the droplet caused by the wetting of the counter electrode are well controlled. The control electrodes have saw-thooth shaped boundaries facing one another. Because the counter electrode is much narrower than the control electrodes, the electrical field of the control electrodes effectively influences the adhesion of the fluid droplet with the stack of electrodes. The counter electrode 31 is in much better electrical contact with the fluid droplet than the control electrodes so that the electrical potential of the fluid droplet 37 remains equal to the potential of the counter electrode.

FIG. 3 shows a schematic cross section of an embodiment of the system for manipulation of a fluid droplet. In particular FIG. 3 shows a cross section along the plane B-B transverse to the surface of the substrate 40. From FIG. 3 it is clear that the counter electrode 31 is narrower than the control electrodes 33,34 and the fluid droplet extends over the control electrodes. Over the electrical insulation layer 32 the hydrophobic coating 41 is applied. As an alternative the electrical insulation layer may be formed of a hydrophobic material so that the electrical insulation layer 32 and the hydrophobic layer 41 are formed as a single hydrophobic electrical insulation layer.

FIG. 4 shows a schematic cross section of an alternative embodiment of the system for manipulation of a fluid droplet. In the embodiment shown in FIG. 4 the hydrophobic coating 41 covers both the electrical insulation layer 32 and the counter electrode 31. The hydrophobic coating 41 is much thinner over the counter electrode than over the electrical insulation layer 32. The thickness of the hydrophobic coating may range from a monolayer of one to a few nm to a coating of a few hundred nm (e.g. 200-700 nm) The small thickness of the hydrophobic coating 41 over the counter electrode 31 achieves capacitive coupling of the fluid droplet 37 and the counter electrode. When the hydrophobic coating 41 is employed, the electrical insulation layer does not need to be hydrophobic itself and is for example made of parylene-N. Furthermore, If the counter electrode is thin, it may be deposited on top of layer 41 after which the whole surface consisting of insulator 32 partly covered with electrode 31 is entirely covered with a hydrophobic layer of uniform thickness. This offers advantages regarding ease of construction. The counter electrode may for example be a 10 nm thin metal layer, applied by evaporation through a shadow mask.

The invention claimed is:

1. A system for manipulation of a body of fluid (37), in particular a fluid droplet comprising several control electrodes (33,34) to which an adjustable voltage is applied, a counter electrode (31) having a fixed voltage and being provided between the body of fluid and one of the control electrodes, covering a part of the surface of the respective control electrodes, in particular the ratio of the width of the counter electrode to the width of the control electrodes being in the range from $10^{-5}$ to 0.9.

2. A system for manipulation of a body of fluid as claimed in claim 1, wherein an electrical insulation is provided between the counter electrode and the respective control electrodes.

3. A system for manipulation of a body of fluid as claimed in claim 1, wherein the electrical insulation has a hydrophobic surface facing the body of fluid, in particular a fluid contact coating being disposed on the electrical insulation.

4. A system for manipulation of a body of fluid as claimed in claim 1, wherein the counter electrode has a hydrophobic surface facing the body of fluid, in particular a hydrophobic coating being disposed on the counter electrode.

5. A system for manipulation of a body of fluid as claimed in claim 1, wherein the hydrophobic coating over the counter electrode is much thinner than the electrical insulation, in particular the ratio of the thickness of the hydrophobic coating over the counter electrode relative to the thickness of the electrical insulation is in the range of $10^{-3}$. to 1, in particular less than $10^{-1}$.

6. A system for manipulation of a body of fluid as claimed in claim 1, wherein the control electrodes are arranged in a spatial two-dimensional pattern.

7. A system for manipulation of a body of fluid as claimed in claim 1, wherein the electrical resistance of the layer between the counter electrode and the droplet is smaller than the electrical resistance of the layer between the control electrodes and the droplet.

8. A system for manipulation of a body of fluid as claimed in claim 1, comprising an electrical control system to activate control electrodes in that an electrical voltage is applied to individual control electrodes and de-activate control electrodes in that individual de-activated control electrodes are electrically connected to ground potential.

9. A system for manipulation of a body of fluid as claimed in claim 1, wherein the body of fluid is surrounded by one or more fluids that are immiscible with one another and with the fluid of the body of fluid.

* * * * *